US006884173B2

(12) United States Patent
Gauselmann

(10) Patent No.: US 6,884,173 B2
(45) Date of Patent: Apr. 26, 2005

(54) CONFIGURATION TECHNIQUE FOR A GAMING MACHINE

(75) Inventor: Michael Gauselmann, Espelkamp (DE)

(73) Assignee: Atronic International GmbH, Lubbecke (DE)

( * ) Notice: Subject to any disclaimer, the term of this patent is extended or adjusted under 35 U.S.C. 154(b) by 170 days.

(21) Appl. No.: 10/146,571

(22) Filed: May 14, 2002

(65) Prior Publication Data

US 2003/0216182 A1 Nov. 20, 2003

(51) Int. Cl.[7] ..... A63F 9/24
(52) U.S. Cl. ..... 463/42; 463/29
(58) Field of Search ..... 463/16, 17, 18, 463/19, 20, 40, 41, 42

(56) References Cited

U.S. PATENT DOCUMENTS

| | | | | | |
|---|---|---|---|---|---|
| 4,072,930 | A | * | 2/1978 | Lucero et al. | 463/47 |
| 5,429,361 | A | * | 7/1995 | Raven et al. | 463/25 |
| 5,470,079 | A | * | 11/1995 | LeStrange et al. | 463/25 |
| 5,575,717 | A | * | 11/1996 | Houriet et al. | 463/1 |
| 5,655,961 | A | * | 8/1997 | Acres et al. | 463/27 |
| 5,759,102 | A | | 6/1998 | Pease et al. | 463/42 |
| 5,919,091 | A | * | 7/1999 | Bell et al. | 463/25 |
| 6,089,979 | A | * | 7/2000 | Klein | 463/25 |
| 6,135,887 | A | | 10/2000 | Pease et al. | 463/42 |
| 6,219,836 | B1 | | 4/2001 | Wells et al. | 717/11 |
| 6,254,483 | B1 | | 7/2001 | Acres | 463/26 |
| 6,364,769 | B1 | * | 4/2002 | Weiss et al. | 463/29 |
| 6,379,246 | B1 | * | 4/2002 | Dabrowski | 463/16 |
| 6,383,076 | B1 | * | 5/2002 | Tiedeken | 463/40 |
| 6,409,602 | B1 | * | 6/2002 | Wiltshire et al. | 463/42 |
| 6,656,048 | B1 | * | 12/2003 | Olsen | 463/25 |
| 2002/0116615 | A1 | * | 8/2002 | Nguyen et al. | 713/168 |
| 2003/0190958 | A1 | * | 10/2003 | Paulsen | 463/42 |
| 2003/0228912 | A1 | * | 12/2003 | Wells et al. | 463/43 |

FOREIGN PATENT DOCUMENTS

| | | | |
|---|---|---|---|
| EP | 1 004 970 A3 | | 6/2001 |
| WO | WO 99/65579 | | 12/1999 |
| WO | WO 01/19474 A1 | | 3/2001 |
| WO | WO 01/20424 A2 | | 3/2001 |
| WO | WO 01/99067 | * | 12/2001 |

* cited by examiner

*Primary Examiner*—Michael O'Neill
(74) *Attorney, Agent, or Firm*—Patent Law Group LLP; Brian D. Ogonowsky

(57) ABSTRACT

A plurality of EGMs are connected within a network. Each of the EGMs is remotely configurable so as to enable an operator to select any desired parameter of the game. The configuration of one EGM may be uploaded to the network and programmed into other EGMs connected to the network. An operator may program the initial EGM at the EGM itself or remotely. In another embodiment, one EGM (a master) may download its configuration settings into other EGMs.

20 Claims, 7 Drawing Sheets

CONFIGURATION TECHNIQUE FOR A GAMING MACHINE

FIELD OF THE INVENTION

This invention relates to gaming machines and, in particular, to a technique for configuring parameters of a gaming machine connected in a network.

BACKGROUND

Many modern electronic gaming machines (EGMs) include a communications board that communicates accounting and other data from the gaming machine to a central server run by the casino. In this way, all the data from the gaming machines is retrievable from one location rather than requiring a casino attendant to physically go to each of the gaming machines to obtain the information. Another recent trend has been to program various aspects of the gaming machines via the central server.

The present invention relates to a convenient and reliable way to program game characteristics into one or a plurality of EGMs.

SUMMARY

A plurality of EGMs are connected within a network. Each of the EGMs is configurable so as to enable an operator to select any available parameter of the game, such as the type of game offered by the EGM, denominations accepted, bet per payline (assuming a video or physical reel-type slot machine), average payback percentage, or any other parameter. The EGMs have at least some of these possible parameters stored in the EGM's memory.

An operator, physically at an EGM, initializes a configuration program in the EGM, which presents the possible configurations to the operator on a display screen. The operator then makes his selection of the various parameters offered by the menu-driven program. When finished, the operator then uploads the settings to a central computer memory, along with the EGM's unique ID code. This initial EGM may now be played with the new settings. To create the same settings in other EGMs, the network then downloads the settings from the initial EGM to those other EGMs, so that they are all configured the same.

All the initial settings may, instead, be directly defined via an operator's console without the operator being physically present at any EGM. The settings are then downloaded to any designated EGM.

In another embodiment, one EGM (a master) may download its configuration settings into other EGMs.

Configuration setting changes may also be made to the EGMs after they have been initially configured, such as for changing the sound levels and average payout percentages for different times of the day or for different days of the week. The system waits until an EGM is not in use, commands the EGM to be in an out-of-service mode, and then downloads the new settings. The EGM is then switched back to a play mode.

Additional embodiments are described.

DETAILED DESCRIPTION

The invention is primarily software related, and numerous hardware implementations are possible in conjunction with the invention. One particular gaming machine platform and network will be described as an example.

Figure 1:
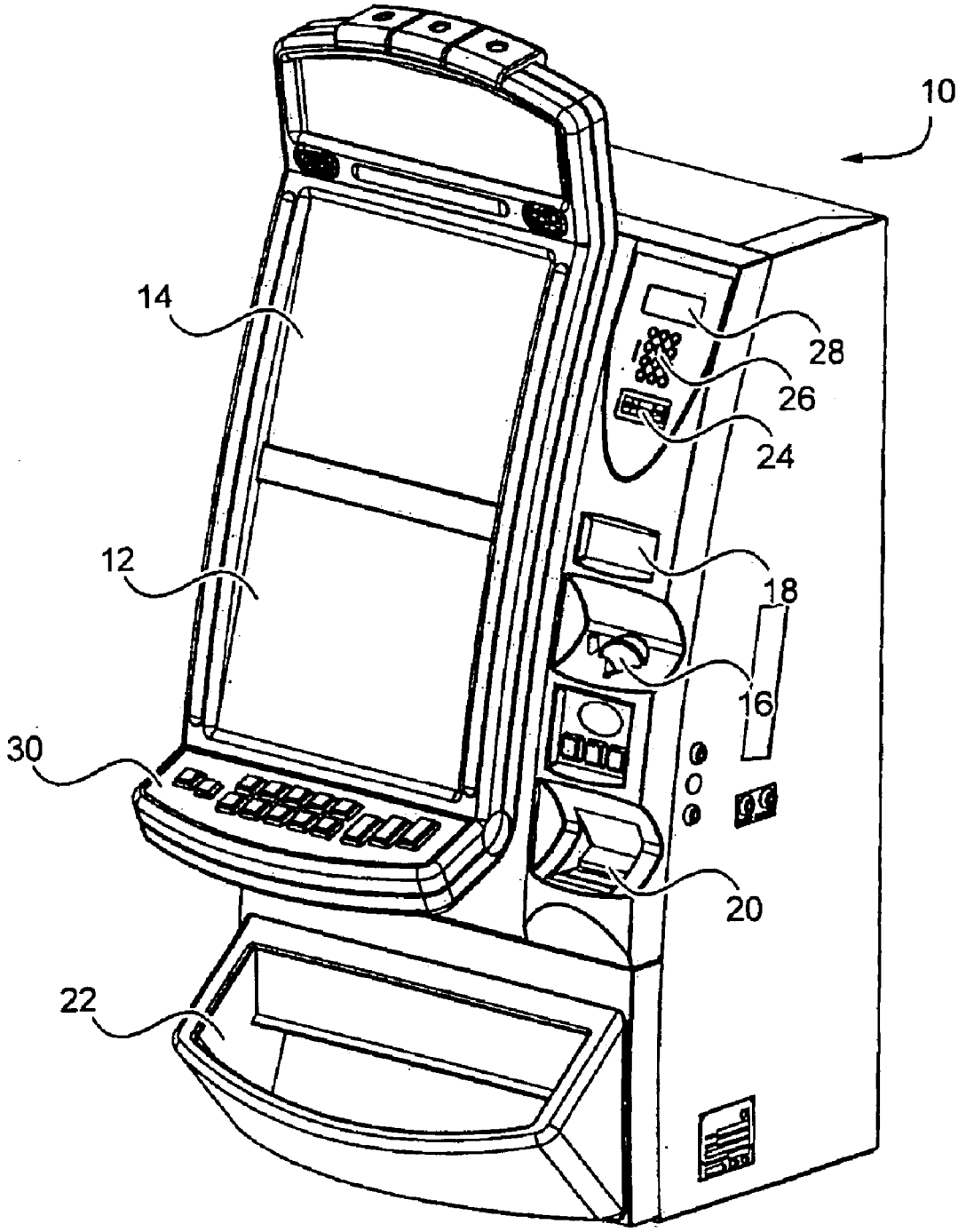
FIG. 1 illustrates one type of EGM that can receive and transmit data via a communications link to a network.

FIG. 1 is a perspective view of a gaming machine 10 that can be used in the present invention. Machine 10 includes a display 12 that may be a thin film transistor (TFT) display, a liquid crystal display (LCD), a cathode ray tube (CRT), or any other type of display. A second display 14 provides game data or other information in addition to display 12. Display 14 may provide static information, such as an advertisement for the game, the rules of the game, pay tables, paylines, or other information, or may even display the game itself along with display 12. Alternatively, the area for display 14 may be a display glass for conveying information about the game.

A coin slot 16 accepts coins or tokens in one or more denominations to generate credits within machine 10 for playing games. An input slot 18 for an optical reader and printer receives machine readable printed tickets and outputs printed tickets for use in cashless gaming. A bill acceptor 20 accepts various denominations of banknotes.

A coin tray 22 receives coins or tokens from a hopper upon a win or upon the player cashing out.

A card reader slot 24 accepts any of various types of cards, such as smart cards, magnetic strip cards, or other types of cards conveying machine readable information. The card reader reads the inserted card for player and credit information for cashless gaming. The card reader may also include an optical reader and printer for reading and printing coded barcodes and other information on a paper ticket.

A keypad 26 accepts player input, such as a personal identification number (PIN) or any other player information. A display 28 above keypad 26 displays a menu for instructions and other information and provides visual feedback of the keys pressed.

Player control buttons 30 include any buttons needed for the play of the particular game or games offered by machine 10 including, for example, a bet button, a repeat bet button, a play two-ways button, a spin reels button, a deal button, hold cards buttons, a draw button, a maximum bet button, a cash-out button, a display paylines button, a display payout tables button, and any other suitable button. Buttons 30 may be replaced by a touch screen with virtual buttons.

Figure 2:
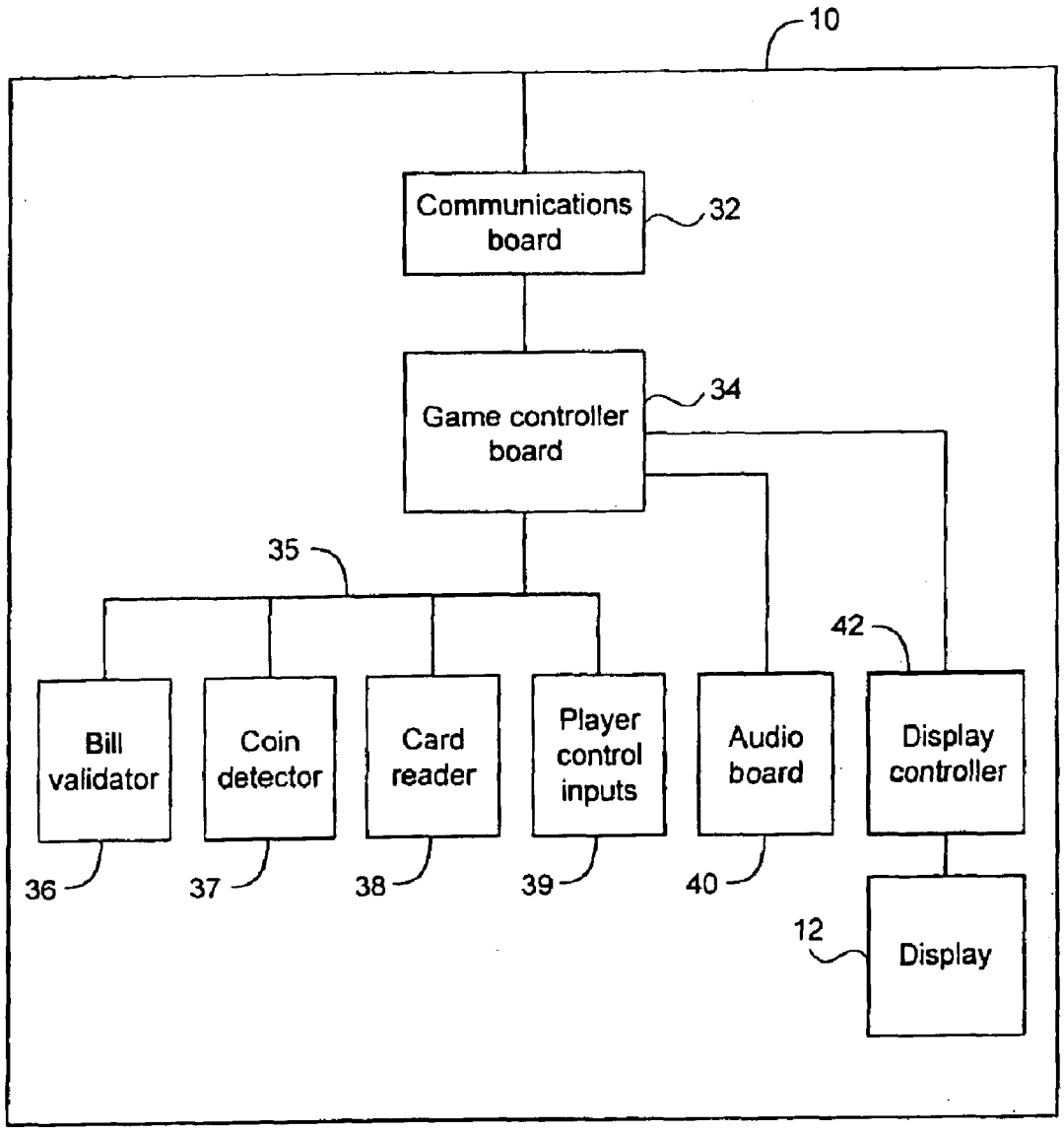
FIG. 2 is a block diagram of various functional blocks in the EGM of FIG. 1.

FIG. 2 illustrates basic circuit blocks in a suitable gaming machine 10. The gaming device 10 may use conventional hardware. A communications board 32 may contain conventional circuitry for coupling the gaming machine 10 to a local area network (LAN) or other type of network using Ethernet or any other protocol. The communications board 32 transmits using a wireless transmitter, or it may be directly connected to a network running throughout the casino floor. The communications board 32 basically sets up a communication link with a network server and buffers data between the network and the game controller board 34.

The game controller board 34 contains memory and a processor for carrying out programs stored in the memory and for providing the information requested by the network. The game controller board 34 carries out the game routine and applies various configurable parameters to the game routine, which will be discussed in detail below.

Peripheral devices/boards communicate with the game controller board 34 via a bus 35 using, for example, an RS-232 interface. Such peripherals may include a bill validator 36, a coin detector 37, a smart card reader or other type of credit card reader 38, and player control inputs 39 (such as the various buttons 30 shown in FIG. 1 or a touch screen). An audio board 40 converts coded signals into analog signals for driving speakers. A display controller 42, which typically requires a high data transfer rate, converts coded signals to pixel signals for the display 12. Display controller 42 and audio board 40 may be directly connected to parallel ports on the game controller board 34.

The electronics on the various boards may be combined onto a single board.

Figure 3:
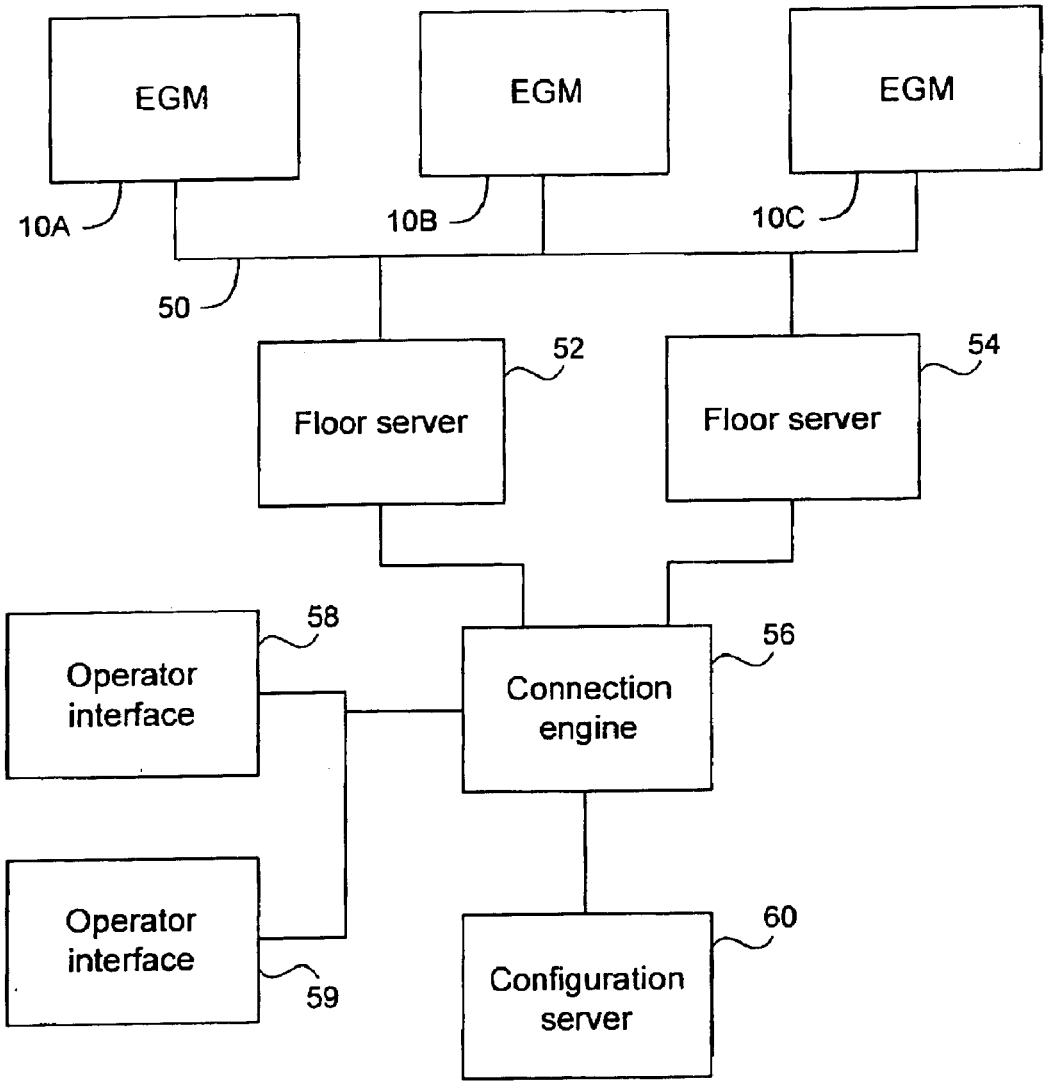
FIG. 3 is a block diagram of one example of multiple EGMs connected to a network.

FIG. 3 is a simplified block diagram of one type of network for communicating with a plurality of EGMs 10A, 10B, and 10C. Of course, there will be many more EGMs connected to the network. The communication board in each of the EGMs is connected to a network 50. Network 50 may be wireless or use cabling. Floor servers 52 and 54 facilitate communication between the EGMs and other components in the network. The number of floor servers (or their necessity) is determined by the number of EGMs and the amount of daily communication required. Floor servers 52/54 also may perform automatic accounting and other data collection on a periodic basis during normal operation of the EGMs.

The floor servers 52/54 communicate with EGMs identified by a connection engine 56, which sets up a data link to any designated EGM. The connection engine 56 is essentially a router that routes data to the proper floor server.

Each EGM is has a unique ID code that is used to address the EGM and identify transmissions from a particular EGM. The ID code may be permanently stored in an ID chip in the EGM. The connection engine 56 uses a data base of all of these IDs when communicating with the EGMs. Alternatively, a software routine may be performed to assign a unique ID to each of the EGMs, and the ID is then stored in both the EGM memory and an external memory.

Operator interface terminals 58 and 59 (workstations) are provided to enable an operator to control the various communications to and from specific ones of the EGMs.

A configuration server 60, whose function will be described in detail below, stores the game configurations of all the EGMs so as to be able to download a particular configuration of one EGM to any other EGM.

In one embodiment, all communications between the EGMs and the network is encrypted. XML (eXtensible Markup Language) may be used as a data exchange format. The particular implementation of the network is not significant for this invention, and various other types of systems would also be adequate.

Once the EGMs are connected to the network and have all been assigned unique ID codes, the EGMs must be configured with various parameters determined by casino or jurisdictional requirements.

Figure 4:
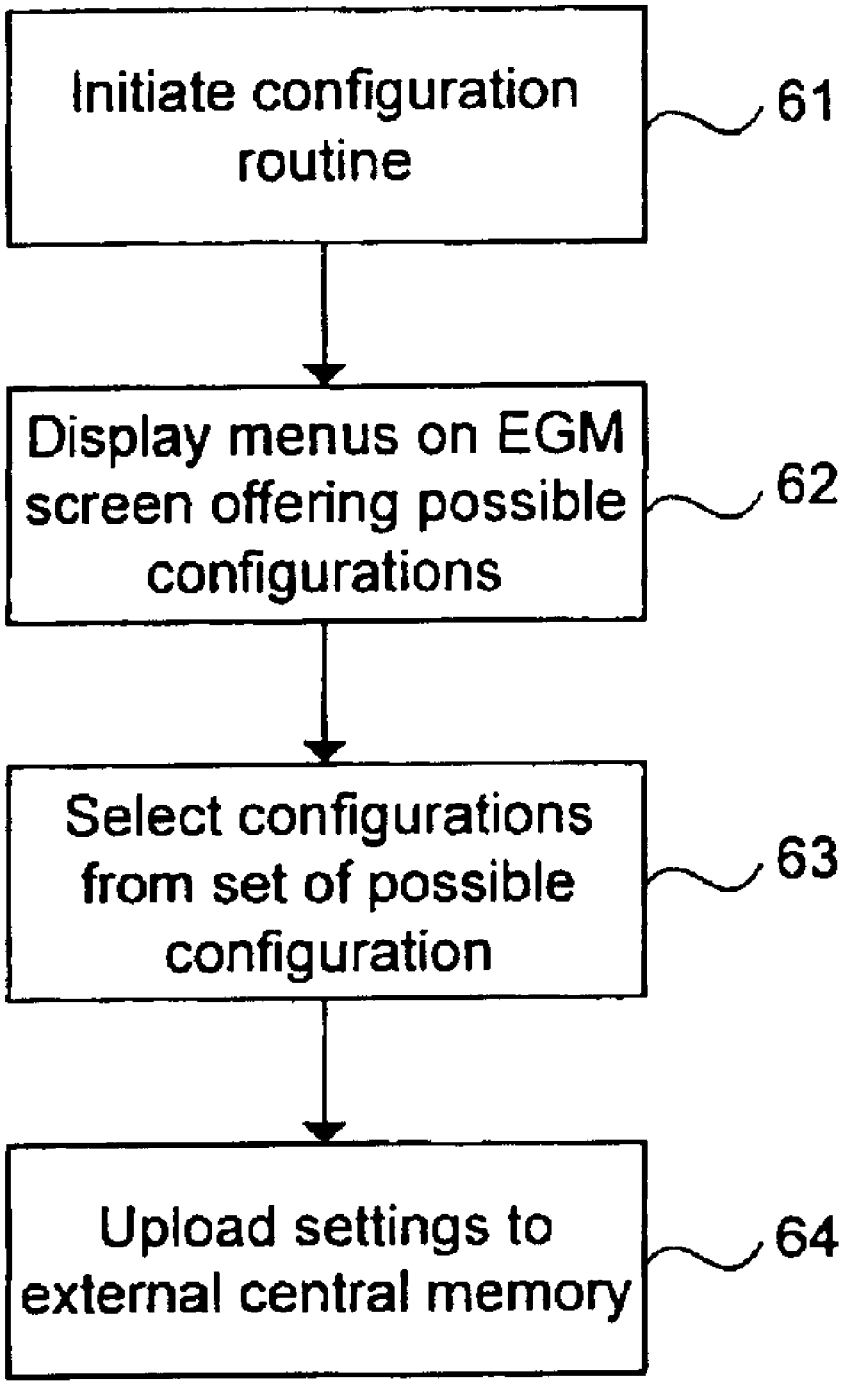
FIG. 4 is flowchart of a method to initially configure an EGM.

FIG. 4 is a flowchart illustrating one technique for configuring the EGMs.

In step 61 of FIG. 4, a casino attendant opens the front door of one of the EGMs (e.g., EGM 10A) and sets a switch to convert the EGM to a configuration mode. Such setting of the mode may also be performed using a key or by other means, such as a coded entry into keypad 26. The first display on the screen may provide instructions to the operator on how to configure the machine.

In step 62, various menus are displayed presenting the possible configuration settings for the EGM. Assuming the display 12 (FIG. 1) is a touch screen, the setting of the configuration of the "initial" EGM is menu driven with the selections made by the operator touching portions of the screen. All possible configuration settings were previously stored in each of the EGMs.

Figure 5:
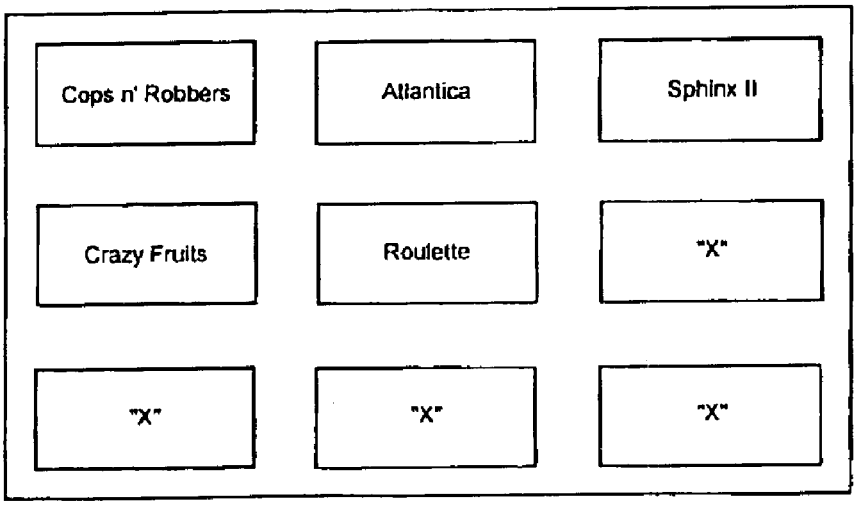
FIG. 5 is a sample menu offering a selection of possible games.

One menu offering the operator a selection of possible configurations may be that shown in FIG. 5, where the possible games are displayed in a matrix. The actual game programs themselves may all be stored in the EGM memory. The operator touches the desired game to set that particular parameter (step 63).

Figure 6:
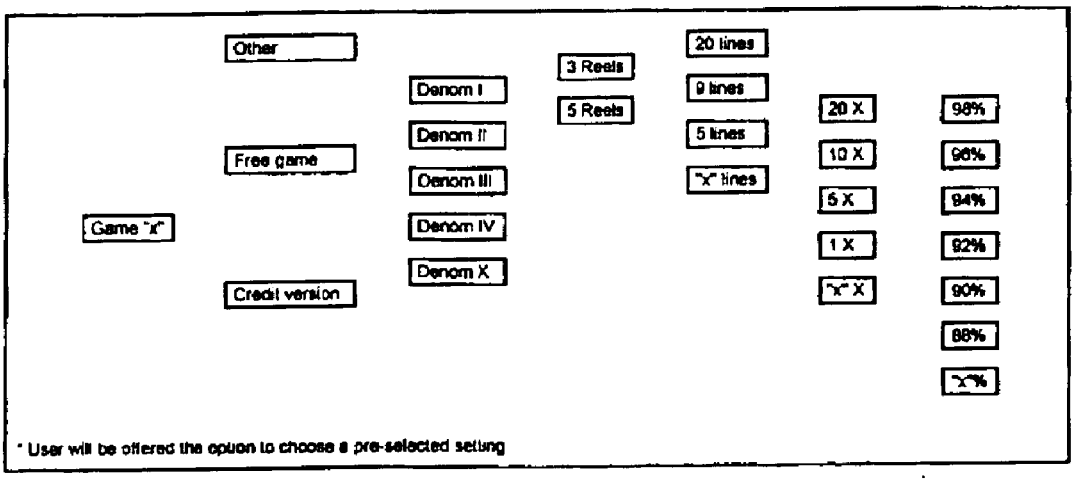
FIG. 6 is a sample menu offering a selection of various game parameters.

A next menu then appears offering the operator other possible configurations, such as shown in FIG. 6. The operator then touches the areas corresponding to the desired parameters to set these parameters. In the illustration of FIG. 6, the possible parameters offered by the menu include whether the game type is a free game type or a credit version, where the free game type may be for demonstrating the operation of the game as an introduction to the players. Other parameters include the acceptable denominations of coins or bills, the number of video reels displayed, the number of paylines, the bet per payline, the average payout percentage, currency exchange rates for converting a value of currency from one country to a value of currency in another country, and sound levels. Once a parameter is selected, it is highlighted on the screen to identify its selection.

Many other types of presentations are possible. Other forms of selection menus may present a number of preselected settings for the operator to choose from rather than requiring the operator to select each individual setting.

Subsequent menus may relate to the sound volume, pay tables, and any other variables.

In step 64, when the operator has finished configuring the EGM, the operator controls the EGM (by, for example, a touch screen button) to upload the settings to the configuration server 60 (FIG. 3) along with the unique ID of the EGM. The configuration of this initial EGM is now stored in the configuration server 60.

The initial EGM, with the new settings, may then be set by the operator to be in the play mode, and play may commence.

As an alternative to the operator being physically at the EGM and entering the configuration via the EGM controls (whether by touch screen or by other types of input devices), the configuration may be set via the operator interface 58/59 in FIG. 3, where a server emulates the EGM, and the operator carries out steps 61–64 in FIG. 4.

Figure 7:
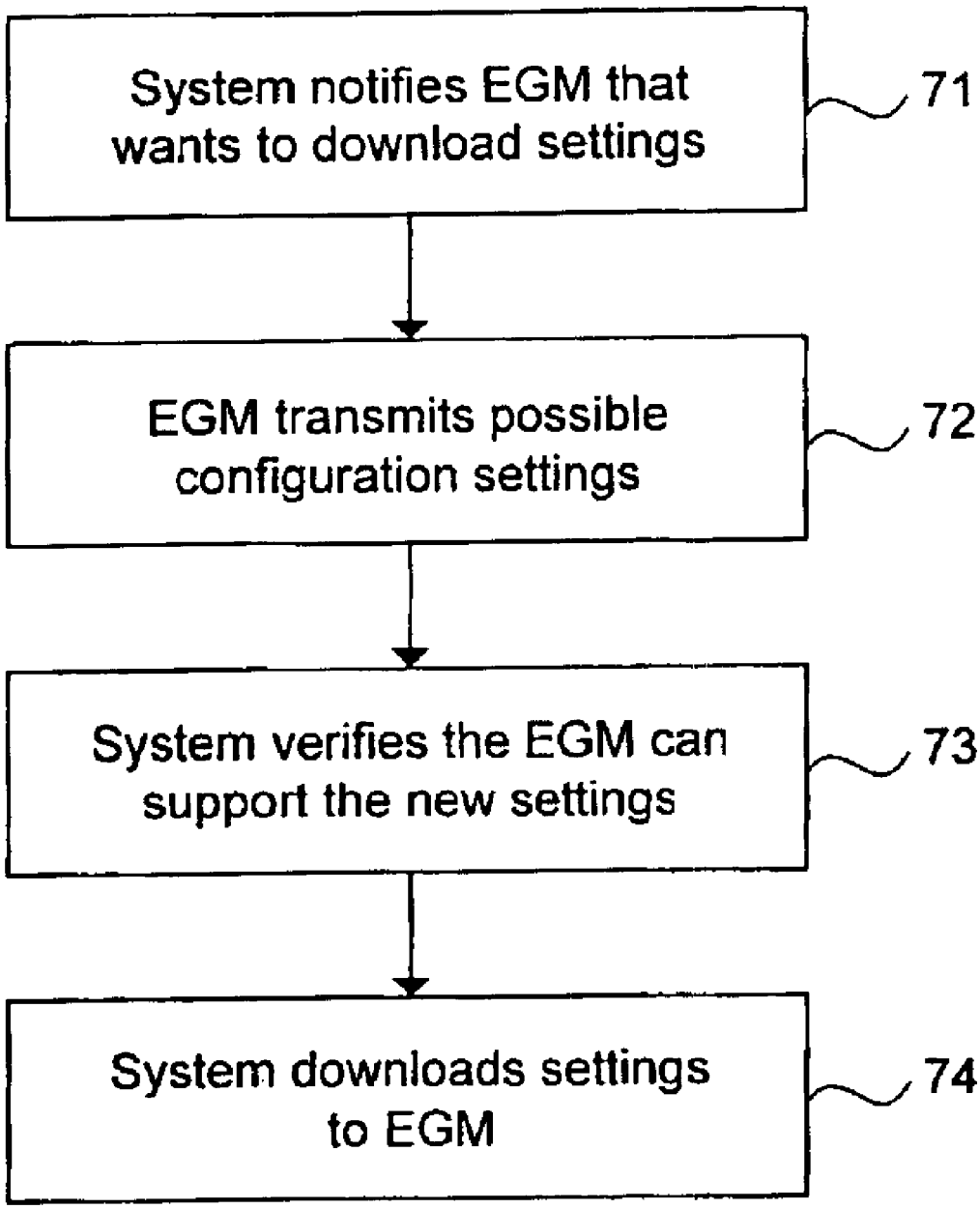
FIG. 7 is a flowchart of a method used to configure EGMs, other than the initial EGM, so all the EGMs have the same configuration settings.

Typically, multiple EGMs are configured in exactly the same way and are located in groups on the casino floor. So that the casino operators do not have to individually program each of the EGMs, the configuration file from configuring the initial EGM, stored in the configuration server 60, may be used to automatically set the configurations of any of the other EGMs, such as EGMs 10B and 10C in FIG. 3. FIG. 7 is a flowchart illustrating such programming.

In step 71 of FIG. 7, an operator at operator interface 58/59 identifies a particular EGM, using the EGM's unique ID, that is to receive a particular predefined configuration. The operator interface 58/59 calls up from the configuration server 60 the configuration settings of the initial EGM 10A. The connection engine 56, in conjunction with the floor servers 52/54, transmits a request to the selected EGM (the target EGM) to transmit all of its possible parameters (step 72) to the configuration server 60 so that the configuration server 60 can verify that the EGM can support the preselected settings (step 73). The configuration server 60 thus identifies whether the preselected settings are among the possible settings identified by the target EGM.

Assuming the target EGM can support the settings, the configuration server 60 then downloads the settings to the target EGM (step 74). In one embodiment, the steps 71–73 are performed on a bank of identical EGMs, and the configuration server 60, in conjunction with the connection engine 56 and floor servers 52/54, then broadcasts the download settings to all of the EGMs at the same time.

Of course, conventional hand-shaking and other acknowledgment signals are transmitted back and forth across the network as would be conventional in the field of data transmission. These details are unnecessary to the understanding of the invention.

Figure 8:
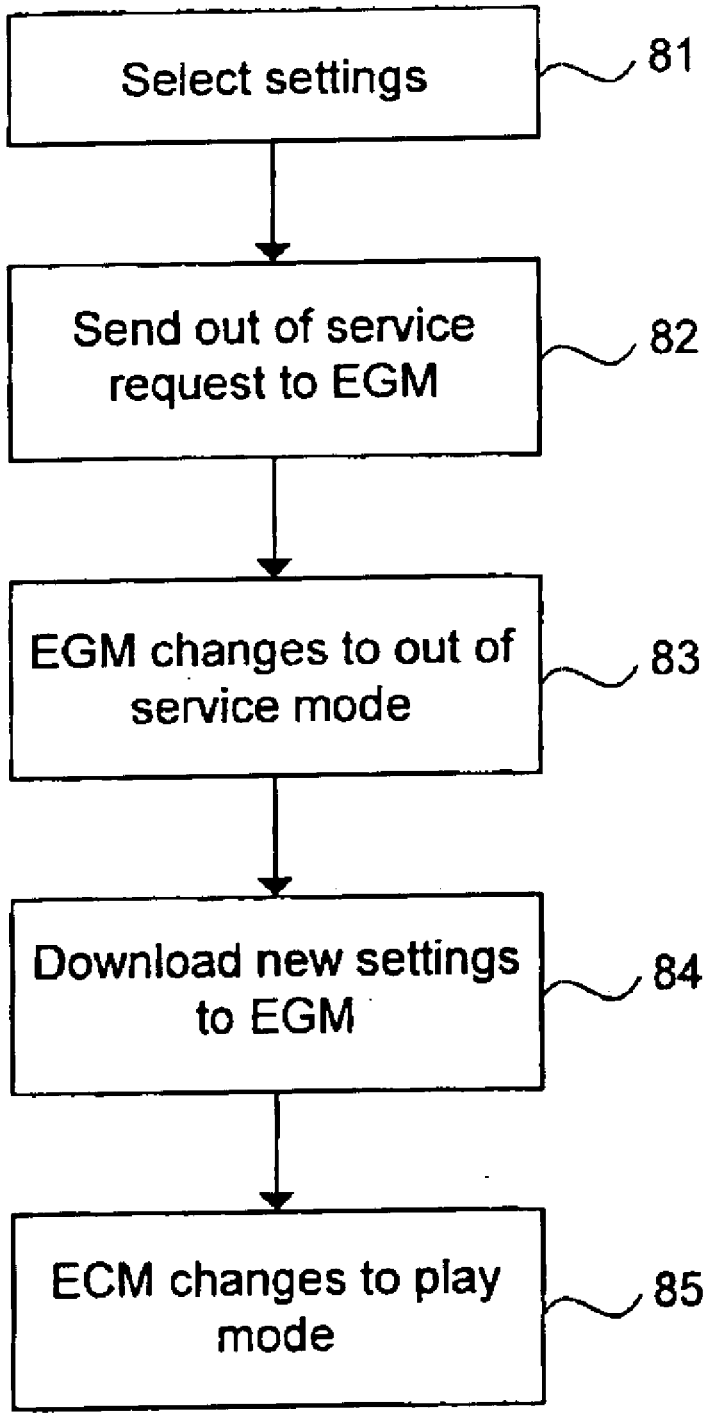
FIG. 8 is a flowchart of a method for reconfiguring EGMs during operation.

If the settings need to be changed for any reason, such settings may be made using the operator interface 58/59. FIG. 8 is a flowchart illustrating how changes may be made during the operation of the EGMs (i.e., after the initial configurations have been downloaded to the EGMs).

In step 81 of FIG. 8, the operator at operator interface 58/59 calls up a particular configuration in configuration server 60, along with all the other possible configuration parameters, and changes the settings as desired. The settings may also be changed using the process of FIG. 4, instead of entering the changes at the operator interface 58/59.

In step 82, once the changes have been made and the new configuration has been set, the operator commands the system to send a remote out-of-service request to a selected EGM. This step and the remaining steps may be performed automatically by a software routine initiated by the operator.

In step 83, the identified EGM changes to an out-of-service mode if there are no credits in the machine (i.e., the machine is not in use), and the machine notifies the system that it is in the out-of-service mode.

In step 84, the configuration server 60, storing the new settings, downloads the new settings to the selected EGM or to a bank of EGMs.

In step 85, after the download, and after any acknowledgments, the selected EGM(s) switches back to the play mode, and play may be commenced using the new settings.

Accordingly, by pre-storing all the possible parameters in the EGMs, not only is it very simple for the attendant to set the configurations of one or more EGMs but it is known with assurance that the EGM(s) can accept a selected configuration.

Further, the system in accordance with one embodiment of the invention can be used with a variety of types of EGMs manufactured by different manufacturers; each EGM would be responsible for identifying the possible parameters acceptable by that EGM. Other advantages stem from this invention due to its simplicity and reliability.

In another embodiment, one of the EGMs in a bank of interconnected EGMs is configured at the EGM by an operator in the manner described with respect to FIG. 4. The configured EGM can then act as a master for the other slave EGMs in the bank. Any of the EGMs in the bank can be the master, and the selection of which EGM is to be the master may depend on which EGM is most convenient to the operator or which EGM is not in use. The configured master EGM is controlled by the operator to download its configuration settings to any of the slave EGMs in the bank. A menu displayed by the master EGM allows the operator to enter the various downloading commands. The master EGM basically performs the functions of the operator interface 58/59, configuration server 60, and communication blocks in FIG. 3. This type of configuration setting technique does not require an external central computer connected via a network to the bank of EGMs; all functions of the central computer may be performed by the master EGM.

If the operator wishes to download the configuration settings from an EGM in one bank to an EGM in another bank, where the banks are not connected, the configuration settings of the EGM are first uploaded to a portable memory device. Such a portable memory device may be a laptop computer, a personal digital assistant (PDA), or any other suitable device. The portable memory device may interface with the EGM via a wireless connection, a USB port, or any other suitable interface. The portable memory device is then transported to the target EGM, and the stored settings are downloaded to the EGM via a suitable interface. Downloading techniques similar to FIG. 7 or 8 may be used, except that the "system" in the flowchart of FIG. 7 is the portable memory device. The target EGM may then be configured as the master for its bank, and the settings may be downloaded to the slave EGMs in the bank. The stored settings in the portable memory device may also be remotely downloaded to any gaming machines in the casino's network.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A method for configuring an electronic gaming machine (EGM), the method comprising:

initiating a configuration routine at a first EGM;

displaying one or more menus on a video screen on the first EGM, the one or more menus offering possible configurations for play of a game on the first EGM, the possible configurations being selected from the group consisting of different games that can be played on the first EGM, different denominations acceptable by the first EGM, a number of reels displayed by the first EGM, a number of paylines that can be played on the first EGM, a bet per payline for a game played by the first EGM, an average payback percentage of the first EGM, a currency exchange rate for converting a value of currency from one country to a value of currency in another country, and a sound level of the first EGM;

receiving signals by the first EGM from an operator at the first EGM selecting configurations from the offered possible configurations;

uploading the configuration settings to an external memory, remote from the first EGM, so as to store the configuration settings in the memory;

identifying at least a second EGM for being configured with the configuration settings of the first EGM;

transmitting by the second EGM its possible configurations to an external server, coupled to the external memory, to allow the server to verify that the second EGM can support the selected configuration settings; and downloading the configuration settings from the external memory to at least the second EGM to store the selected configuration settings in at least the second EGM upon the server verifying that the second EGM can support the settings.

2. The method of claim 1 further comprising changing the configuration settings of an EMU in accordance with a method comprising:

sending an out-of-service request to a selected EGM;

transmitting an acknowledgment by the selected EGM that the EGM is now out of service;

identifying one or more new configuration settings from a set of possible configurations available to the selected EGM;

downloading the new configuration settings to the selected EGM; and the selected EGM switching back to an active play mode.

3. The method of claim 1 further comprising downloading the configuration settings from the external memory to a plurality of EGMs to store the selected configuration settings in the plurality of EGMs.

4. The method of claim 1 wherein the possible configurations comprise a plurality of different games that can be played on the first EGM.

5. The method of claim 1 wherein the possible configurations comprise different denominations acceptable by the first EGM.

6. The method of claim 1 wherein the possible configurations comprise a number of reels displayed by the first EGM.

7. The method of claim 1 wherein the possible configurations comprise a number of paylines that can be played on the EGM.

8. The method of claim 1 wherein the possible configurations comprise a bet per payline in the first EGM.

9. The method of claim 1 wherein the possible configurations comprise an average payback percentage of the first EGM.

10. The method of claim 1 wherein the possible configurations comprise a currency exchange rate for converting a value of currency from one country to a value of currency in another country.

11. The method of claim 1 wherein the possible configurations comprise sound levels.

12. The method of claim 1 wherein the first EGM encrypts data transmitted to a communications link.

13. The method of claim 1 wherein receiving signals comprises receiving signals from a touch screen in the first EGM.

14. The method of claim 1 wherein the configuration routine is initiated by an operator at the first EGM.

15. The method of claim 1 wherein the first EGM is a video slot machine.

16. The method of claim 1 wherein uploading the configuration settings comprises storing the settings in a configuration server connected to the first EGM and second EGM via a communications link.

17. A method for configuring an electronic gaming machine (EGM), the EGM being connected with other EGMs via a communications link, the method comprising:

selecting EGM configuration settings from a set of possible configurations stored in the EGM, the possible configurations being selected from the group consisting of different games that can be played on the first EGM, different denominations acceptable by the first EGM, a number of reels displayed by the first EGM, a number of paylines that can be played on the first EGM, a bet per payline for a game played by the first EGM, an average payback percentage of the first EGM, a currency exchange rate for converting a value of currency from one country to a value of currency in another country, and a sound level of the first EGM;

storing the selected configuration settings in a memory external to the EGM;

identifying one or more other EGMs;

receiving, from the one or more other EGMs, a set of possible configurations for the one or more other EGMs;

verifying that the one or more other EGMs can support the selected configuration settings; and downloading the configuration settings from the memory to the one or more other EGMs.

18. The method of claim 17 wherein selecting EGM configuration settings is performed at a first EGM.

19. The method of claim 18 wherein selecting EGM configuration settings is performed using a touch screen at the first EGM.

20. An electronic gaming system comprising:

a controller in a first electronic gaming machine (EGM) for carrying out a program in a memory, the controller for carrying out the following method:

initiating a configuration routine;

displaying one or more menus on a video screen, the one or more menus offering possible configurations for play of a game on the EGM, the possible configurations being selected from the group consisting of different games that can be played on the first EGM, different denominations acceptable by the first EGM, a number of reels displayed by the first EGM, a number of paylines that can be played on the first EGM, a bet per payline for a game played by the first EGM, an average payback percentage of the first EGM, a currency exchange rate for converting a value of currency from one country to a value of currency in another country, and a sound level of the first EGM;

receiving signals from an operator at the EGM selecting configurations from the offered possible configurations;

uploading configuration settings to an external memory, remote from the first EGM, so as to store the configuration settings in the memory;

a configuration server external to the first EGM and coupled to the external memory for carrying out a program in a memory, the server for carrying out the following method:

identifying at least a second EGM for being configured with the configuration settings of the first EGM;

receiving from the second EGM its possible configurations to allow the server to verify that the second EGM can support the selected configuration settings; and downloading the configuration settings from the external memory to at least the second EGM to store the selected configuration settings in at least the second EGM upon the server verifying that the second EGM can support the settings.

* * * * *